US007701328B2

(12) United States Patent
Wall et al.

(10) Patent No.: US 7,701,328 B2
(45) Date of Patent: Apr. 20, 2010

(54) ALARM MANAGEMENT USING SOURCE ATTRIBUTES

(76) Inventors: Dan Wall, 1376 Hovey Road, Saanichton, BC (CA) V8M 1S7; David A. Chivers, 78 Logan Avenue, Victoria, BC (CA) V9A 1H3; Peter Tovey, 812 Gannet Court, Victoria, BC (CA) V9B 6V6; Oleksandr Kravchenko, 4434 Valmont Place, Victoria, BC (CA) V8N 5R6; Marcus Gasper, 250 Sarah Way, Saltspring Island, BC (CA) V8K 2X8; John C. Van Gorp, 2033 Odlum Place, Sidney, BC (CA) V8L 4J6

( * ) Notice: Subject to any disclaimer, the term of this patent is extended or adjusted under 35 U.S.C. 154(b) by 318 days.

(21) Appl. No.: 11/845,630

(22) Filed: Aug. 27, 2007

(65) Prior Publication Data

US 2009/0058631 A1 Mar. 5, 2009

(51) Int. Cl.
*G08B 29/00* (2006.01)

(52) U.S. Cl. ..... 340/506; 340/511; 340/3.1; 340/825.36; 340/825.49

(58) Field of Classification Search ..... 340/506, 340/511, 517, 521, 524, 3.1, 825.36, 825.49
See application file for complete search history.

(56) References Cited

U.S. PATENT DOCUMENTS

| | | | | |
|---|---|---|---|---|
| 4,153,836 | A | | 5/1979 | Simm |
| 5,400,246 | A | * | 3/1995 | Wilson et al. ..... 700/17 |
| 5,682,949 | A | | 11/1997 | Ratcliffe et al. |
| 7,233,843 | B2 | | 6/2007 | Budhraja et al. |
| 2005/0171645 | A1 | | 8/2005 | Oswald et al. |
| 2005/0197847 | A1 | | 9/2005 | Smith |

* cited by examiner

*Primary Examiner*—Daryl Pope

(57) ABSTRACT

An alarm management system includes an alarm management system server ("alarm server"), one or more data sources, and one or more system users (and associated user devices), all of which can be communicably connected through a communications network. The system can be configured by defining the data sources and users, defining attributes, assigning and associating attribute values with the data sources and users, and defining alarm conditions in terms of attribute values and measurements. The data sources generate measurement data which is provided to the alarm server, and the alarm server evaluates the data to determine whether the alarm conditions have been met. A data set of data sources matching alarm conditions can be generated and reported to one or more of the users.

30 Claims, 6 Drawing Sheets

ALARM MANAGEMENT USING SOURCE ATTRIBUTES

CROSS-REFERENCE TO RELATED APPLICATIONS

Not applicable.

BACKGROUND OF THE INVENTION

1. The Field of the Invention

The present invention relates generally to systems and methods for monitoring energy delivery networks. More particularly, embodiments of the invention relate to systems and methods for operating alarm management systems that monitor energy delivery networks.

2. The Relevant Technology

Electricity has become an indispensable part of people's lives and is used in many aspects of life. Homes, businesses, factories, and communities all use varying amounts of electricity. In practical terms, all of the devices, machines, motors, air conditioning equipment, fans, manufacturing equipment, other electrically powered industrial equipment, etc., that need electricity to operate can be viewed as some type of load.

While the electricity delivered to a particular consumer is usually measured by the power company for various purposes including billing purposes, monitoring the electrical power consumption and other aspects of electricity delivered to an individual load, circuit or other point in an energy delivery network is not usually performed by the power company. Although not monitored by the power company, this information is often desired by certain consumers (e.g., factories, apartment buildings, businesses, etc.) in order to identify ways to reduce utility costs, optimize equipment utilization, and improve system reliability.

Various power management systems have been developed that assist consumers in obtaining some or all of the information they desire. Such power management systems often include meters installed at key points for monitoring various entities such as loads, generators, substations, service entrances, mains, feeders, etc. The meters generate data which can be collected and analyzed. By installing more meters and collecting more data, more information can be obtained that may be useful for consumers. However, as the number of meters increases and the amount of data grows, it becomes increasingly more difficult to organize, configure and operate power management systems.

Conventional power management systems define and generate alarms inconveniently using an alarm management system. For instance, an alarm can be defined that causes a notification to be sent to a system user upon the occurrence of a particular condition at a particular entity. However, these alarms are typically defined one entity at a time. Further, when one or more monitored entities are added to the system or the organization of the monitored entities in the system is altered, some or all of the alarms and/or the organization of the system have to be redefined one entity at a time. This entity-by-entity alarm system reconfiguration can represent a significant cost to consumers in terms of both time and money.

Furthermore, it can be difficult or even impossible to configure conventional power management systems to aggregate & filter alarms. Consequently, the triggering of an upstream alarm can result in the triggering of one or more downstream alarms, thereby causing a system user to receive an unmanageable amount of unnecessary alarms. Additionally, in conventional systems false alarms are often triggered when equipment is taken out of service, which can similarly cause a system user to receive unnecessary alarms.

The subject matter claimed herein is not limited to embodiments that solve any disadvantages or that operate only in environments such as those described above. Rather, this background is only provided to illustrate one example technology area where some embodiments described herein may be practiced.

BRIEF SUMMARY OF THE INVENTION

Embodiments of the invention are directed to methods and systems for operating an alarm management system for an energy delivery network. In particular, embodiments of the invention enable the definition of alarm conditions and alarm exceptions in terms of attribute values and measurement types. Advantageously, this permits alarms to be defined on groups of entities sharing common attribute values rather than one entity at a time. Furthermore, alarms can be defined in terms of numeric values and/or attribute values. In this manner, the cost of configuring and operating an alarm management system can be greatly reduced.

In one example embodiment, an alarm management system server is configured by first defining entities within the system. The entities can be data sources and/or system users. The data sources may be capable of generating data for one or more measurement types. Attributes are defined and attribute values corresponding to the attributes are assigned to the entities within the system, whereupon the server associates the attribute values with the entities. Alarm conditions and alarm exceptions can be defined in terms of attribute values and measurement types.

The alarm management server receives measurement data from one or more data sources and then evaluates it to determine whether the alarm conditions and/or alarm exceptions have been met. When alarm conditions are met by measurement data from data sources, a data set can be generated and/or reported to users or entities of the system that identifies the matching data sources. When alarm exceptions are met, corresponding alarm conditions may be disabled. In some embodiments, an alarm notification can be provided to a user of the system by including an attribute value of the user in the alarm condition. The alarm notification may be in the form of a message transmitted to a user device and/or the alarm can be displayed on a dedicated monitoring device that displays active alarms for the system. Furthermore, alarm notifications can be distributed to multiple users or entities of the system that share one or more common attributes values included in the alarm condition. By changing the attribute values assigned to entities, the alarm notification behavior (e.g., which entities receive alarm notifications) can also be changed.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
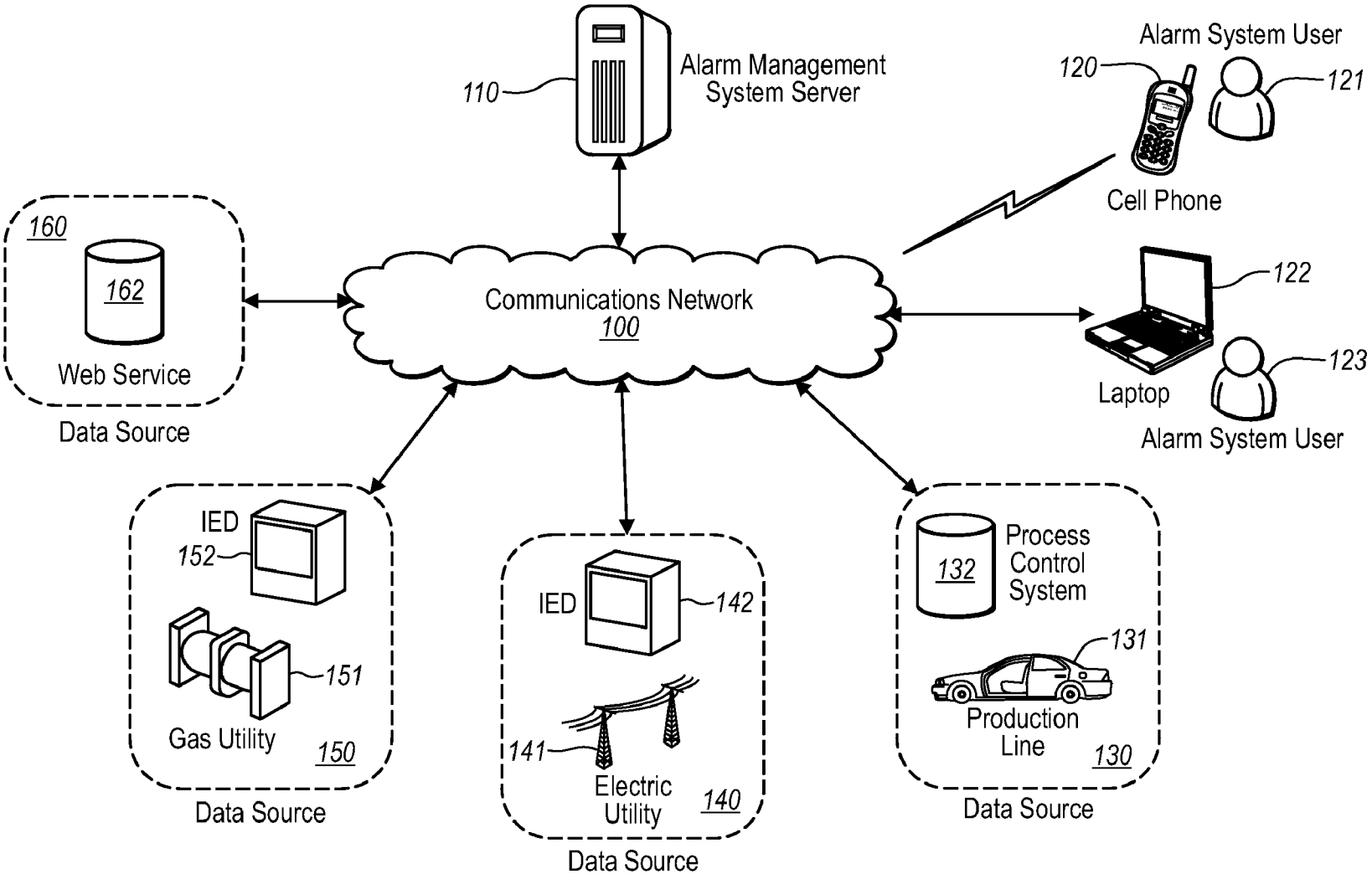
FIG. 1 illustrates one embodiment of an alarm management system in which the principles of the present invention may be practiced.

Reference will now be made to the drawings to describe various aspects of exemplary embodiments of the invention. It should be understood that the drawings are diagrammatic and schematic representations of such exemplary embodiments and, accordingly, are not limiting of the scope of the present invention, nor are the drawings necessarily drawn to scale.

The principles of the present invention relate to methods and systems for operating an alarm management system for an energy delivery network. The alarm management system includes an alarm management system server and one or more entities including data sources and alarm system users. In one embodiment, attributes can be defined and attribute values can be assigned to and associated with the data sources by alarm system users, thereby giving the data sources meaning in the context of the system. Data sources having the same attribute value can be grouped together. In this manner, each alarm system user can organize data sources hierarchically as viewed by the particular user. In other words, attributes enable arbitrary, user-defined hierarchies without the need for rigid hierarchical structures.

The use of attributes and attribute values further enables the implementation of alarms. Alarm conditions and alarm exceptions can be defined in terms of attribute values and measurement data received from the data sources. The alarm management system server evaluates the alarm conditions/exceptions using the attribute values and measurement data to determine whether the alarm conditions/exceptions have been met. When alarm conditions are met, alarms can be provided or reported to alarm system users or other entities having an attribute value identified in the alarm condition. Advantageously, the alarms can be defined on groups of data sources (e.g., data sources sharing a common attribute value) rather than one source at a time. Additionally, attributes can be used as part of an alarm criterion itself. For instance, an "under nominal current" alarm can be defined for all data sources in a system where different data sources have different nominal currents, by defining a "Nominal Current" attribute, creating an alarm affecting all data sources, and choosing the "Nominal Current" attribute as the threshold.

Further, numerical values and/or multiple attributes can be used as part of an alarm criterion. For example, using the "Nominal Current" attribute just mentioned and a "Nominal Voltage" attribute, an alarm can be defined that is triggered when both of two conditions are met at an entity, e.g., when the current at the entity is below the "Nominal Current" of the entity and the voltage at the entity is 10% over the "Nominal Voltage" of the entity.

The users or other entities to which the alarm is reported can be defined in the alarm condition itself using attributes and attribute values assigned to the users or other entities. As an example, an alarm can be reported to a specific group of system users (such as all of the managers of the first floor of a data center) by defining an alarm condition or notification in terms of a "Location" user attribute and a "Job Title" user attribute such that the alarm is reported to all users having a location attribute value equal to "first floor of data center" and a job title attribute value equal to "manager."

Referring to FIG. 1, one embodiment of an alarm management system is illustrated comprising one or more data sources 130, 140, 150, and 160, a communications network 100, an alarm management system server ("alarm server") 110, alarm system users 121 and 123, and user devices 120 and 122. The alarm server 110 and data sources 130, 140, 150 and 160 are communicably coupled with the communications network 100. In operation, the alarm server 110 acquires measurement data from the data sources 130, 140, 150, and 160, compares the measurement data received against preconfigured alarm conditions and alerts alarm system users 121 and 123 via the user devices 120 and 122 when the data received matches at least one of the preconfigured alarm conditions. These operations of the alarm server 110 will be described in further detail below.

While the server 110 is described herein as an alarm management system server configured to perform some or all of the alarm management functions discussed herein, one skilled in the art will appreciate that the server 110 can additionally accommodate other server functions. Further, the functions and capabilities of the alarm server described herein can be implemented in hardware, software, or any combination thereof. Moreover these functions can be distributed among a plurality of servers and/or other devices.

Figure 2:
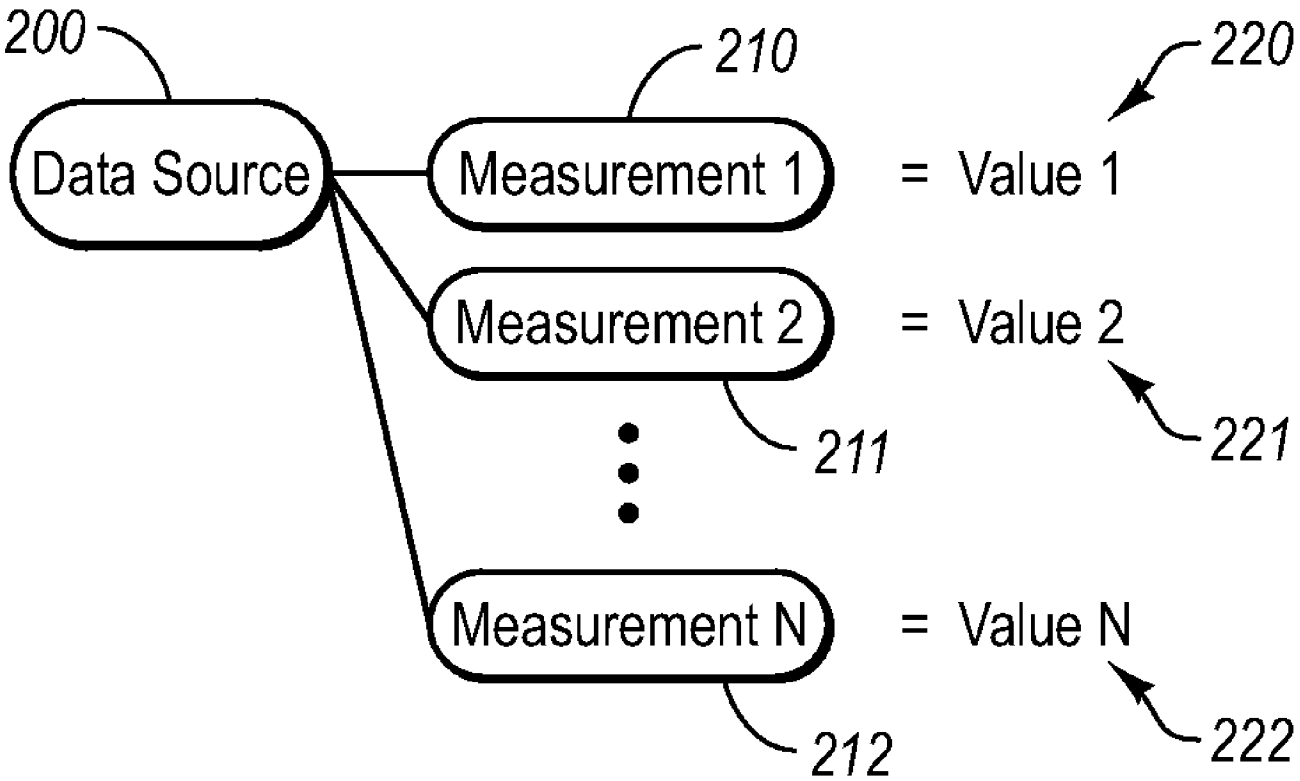
FIG. 2 depicts various measurement types and measurement data that can be generated by a data source.

The data acquired from the data sources 130, 140, 150, and 160 includes measurement data produced by each of the data sources, the measurement data corresponding to measurement types. For example, FIG. 2 illustrates one embodiment of a data source 200 that may correspond to the data sources 130, 140, 150 and 160 of FIG. 1. The data source 200 is configured to obtain or perform one or more measurement types 210, 211 and 212. As used herein, "measurement type" refers to a particular property, quantity, quality or state measured by the data source 200. By way of non-limiting example, measurement types include electrical energy consumption, gas energy consumption, flow rates, voltage, rms voltage, current, rms current, power, impedance, outdoor ambient temperature, number of units produced on a production line, and the like or any combination thereof. One of skill in the art can appreciate that other measurement types may be identified according to the system.

The data source 200 generates measurement data 220, 221 and 222 for each of the measurement types 210, 211 and 212, respectively. Measurement data may also be referred to as "measurement value(s)". As used herein, "measurement data" refers to a value observed for a particular property, quantity, quality or state of the data source upon performing a corresponding measurement type. For instance, a value of 100 kWh might be observed upon measuring electrical energy consumption. Similarly, values of 10 GJ, 20 degrees Celsius, and 200 units might be observed upon measuring gas energy consumption, outdoor ambient temperature, and number of units produced on a production line, respectively. While numeric values have been provided as examples, it will be appreciated that other types of values may be used, including alphanumeric strings and Boolean states.

Although measurement data for each measurement type can remain constant over time, normally the measurement data varies with time. In some instances, the measurement data is a timed measurement (e.g., total power consumed over a period of time, peak voltage or peak current over some period of time, etc.). In one embodiment, a data source will offer only the most recent measurement value for each measurement type it contains. In another embodiment, however, a data source offers the most recent measurement value as well as a time-stamped set of N previous values for each measurement type it contains. Additionally, in some embodiments a data source can supply historical measurement data, simulated measurement data, or any combination thereof.

Returning to FIG. 1, various types of data sources are illustrated, including information technology sources such as a web service 162 and process control system 132, as well as device sources such as an Intelligent Electronic Device ("IED") 142 and IED 152. One function of an IED is to convert physical measurements (such as voltage, current, temperature and pressure) into digital data that can be stored, processed and transmitted to a central server (e.g., the alarm server 110) for further processing and presentation to users. As shown in FIG. 1, IED 152 converts physical measurements from a gas utility 151 into digital data that can be stored and processed within IED 152 before being transmitted to alarm server 110 via the communications network 100. In a similar fashion, IED 142 converts physical measurements from an electric utility 141 into digital data that can be stored and processed before being transmitted to alarm server 110.

Note that the process control system 132, web service 162, and IEDs 142, 152 are merely illustrative of various components that can be included in a data source, such as those indicated at 130, 140, 150 and 160. As such, the present discussion is not intended to limit the present invention in anyway. The server 110 can interface with specific devices of varying types.

The alarm server 110 acquires measurement data from the data sources 130, 140, 150, and 160 for evaluation against preconfigured alarm condition criteria. In one embodiment, the alarm server 110 continuously scans one or more of the data sources 130, 140, 150, and 160 for current measurement data. In another embodiment, the alarm server 110 acquires data by sending a request to one or more of the data sources 130, 140, 150, and 160 for stored measurement data not previously acquired by the alarm server 110. In yet another embodiment, one or more of the data sources 130, 140, 150, and 160 push measurement data to the alarm server 110. It will be appreciated that the alarm management system illustrated by FIG. 1 may implement one or all of the data acquisition methods described here.

In a typical embodiment, the preconfigured alarm condition criteria are defined in terms of measurement types and/or attribute values. As previously discussed, data sources perform one or more measurement types to obtain one or more measurement values per measurement type. Attributes and attribute values are typically user-defined and are assigned to and associated with the data sources. In addition, attributes and attribute values can be assigned to and associated with the alarm system users 121, 123, as well as other entities within the alarm management system of FIG. 1. Generally speaking, an "attribute" is a category of one or more attribute values. Each "attribute value" typically serves to qualify, identify, classify, quantify or otherwise express a user-defined property or characteristic of an entity.

Figure 3:
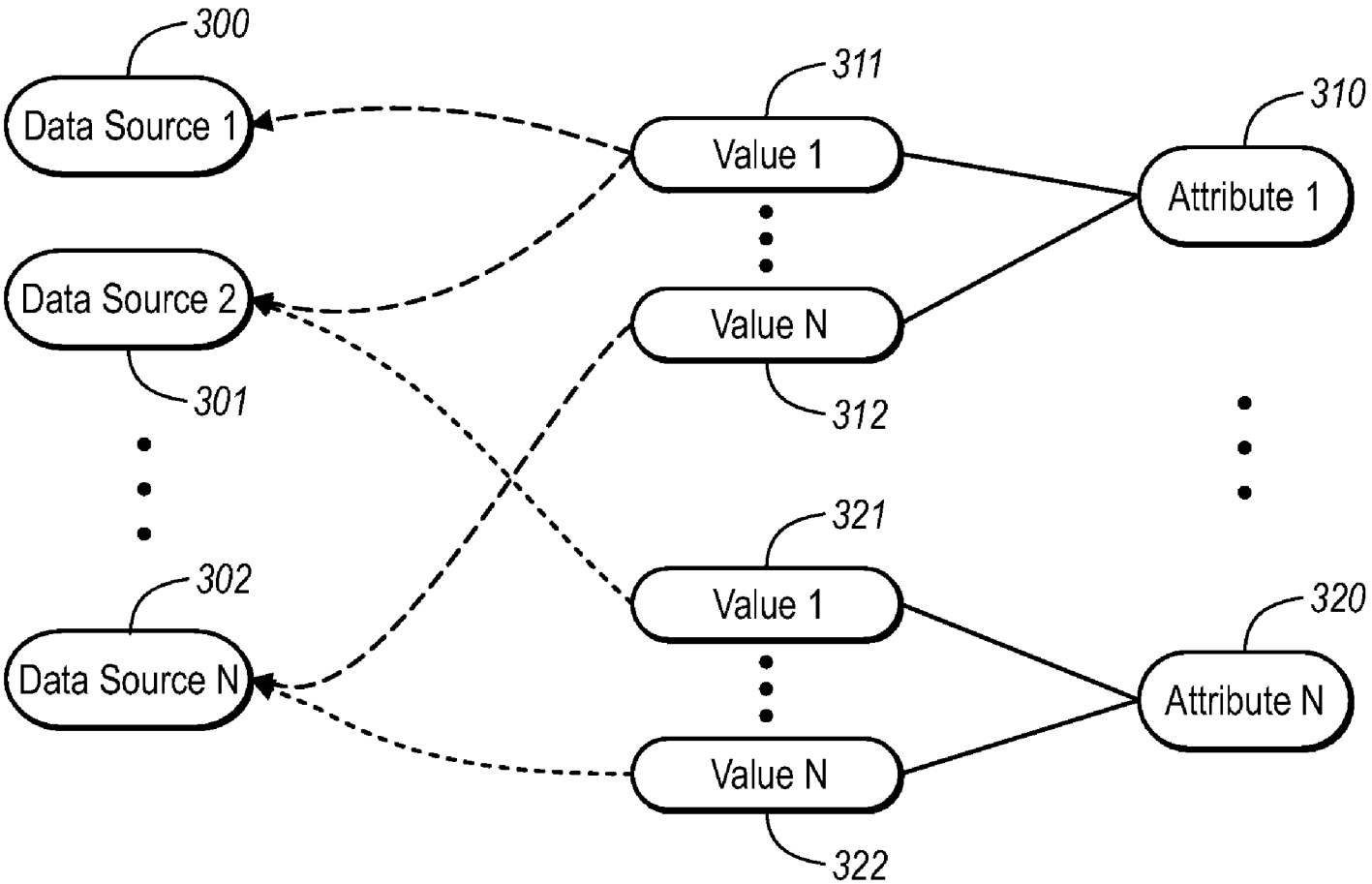
FIG. 3 illustrates one embodiment of the relationship between attributes, attribute values, and entities.

FIG. 3 depicts one embodiment of the relationship between attributes, attribute values and entities. In particular, one or more attribute values 311, 312, 321 and 322 for one or more attributes 310 and 320 are assigned to one or more entities such as the data sources 300, 301 and 302. In the present example, the first data source 300 and the second data source 301 have been assigned a first attribute value 311 corresponding to the first attribute 310. However, the third data source 302 has been assigned a second attribute value 312 corresponding to the first attribute 310. For instance, the first attribute 310 might refer to the city wherein a data source is located. Assuming that the first and second data sources 300 and 301 are located in City A and that the third data source 302 is located in City B, the first attribute value 311 would be City A and the second attribute value 312 would be City B.

While the first data source 300 has only been assigned one attribute value 311, the second and third data sources 301 and 302 have each been assigned two attribute values corresponding to the first and second attributes 310 and 320. For example, the second attribute might refer to a maximum current for the first and second data sources. Attribute value 321 may be greater or less than attribute value 322 depending on which data source 301 or 302 is configured for a higher maximum current. Note that the example attributes and attribute values discussed herein are illustrative only and should not be construed to limit the invention in any way.

FIG. 3 illustrates that new data sources can be easily integrated. Rather than configure each new data source independently of others, the new data source can simply be associated with existing attributes and attribute values. The associated alarms are already defined for those attributes and attribute values. Further, the alarms associated with a particular data source can be altered by simply changing the attributes and attribute values associated with the particular data source. This advantageously eliminates the need to reconfigure alarms and alarm conditions at the data source itself. The data source can continue to report measurement values, but the reported values can be interpreted in a different way. This provides flexibility and scalability to the ability to monitor the various data sources.

Figure 4:
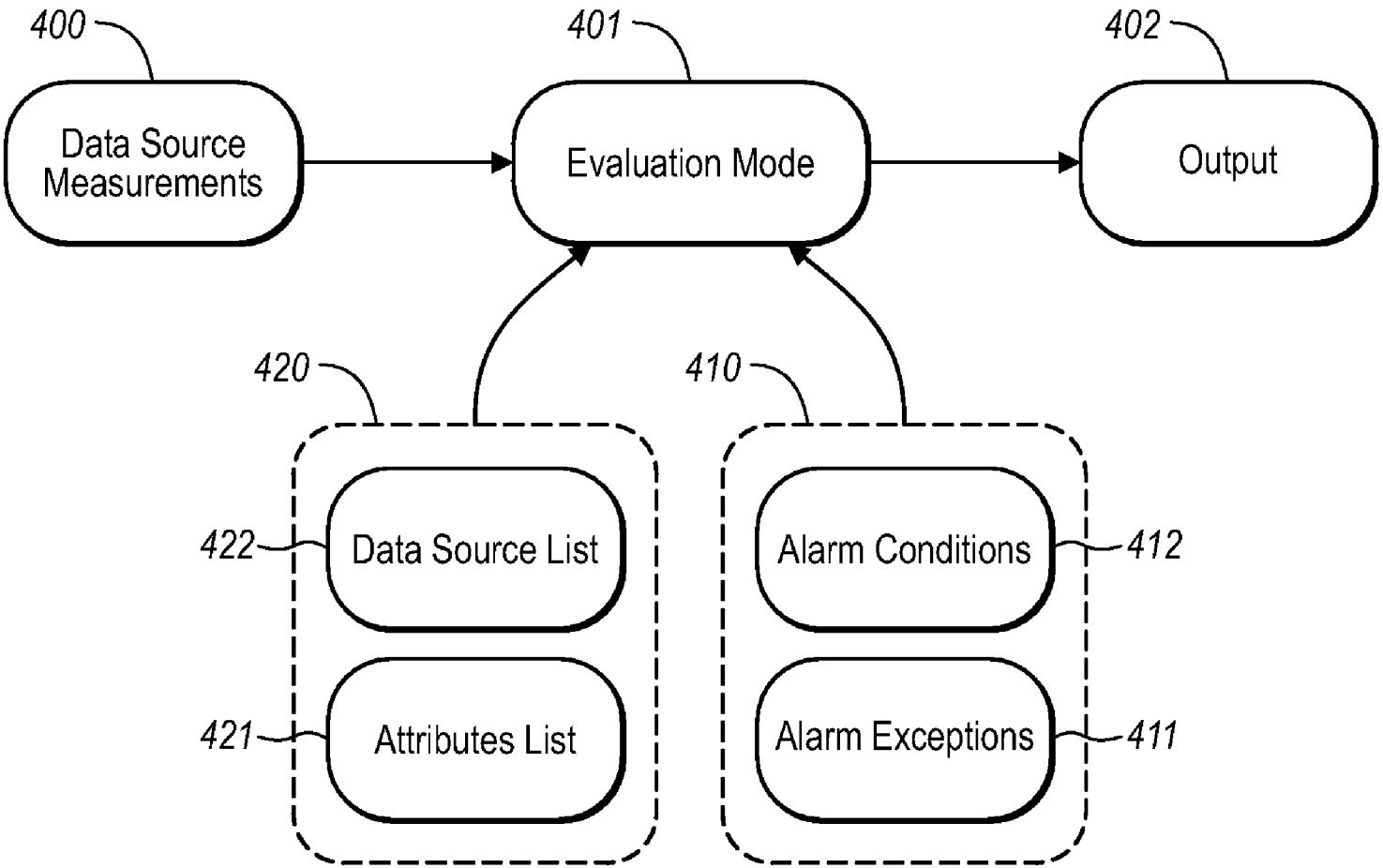
FIG. 4 depicts one embodiment of an evaluation module that can be implemented to evaluate measurement data, alarm conditions and alarm exceptions.

FIG. 4 illustrates one embodiment of an evaluation module 401 for evaluating measurement data from an energy delivery network using attribute values. The evaluation module 401 may be implemented in the alarm management system server 110 of FIG. 1, for example. FIG. 4 further illustrates the various inputs and outputs of the evaluation module 401. In particular, the evaluation module 401 receives measurement data 400 from data sources and applies definitions 420 and rules 410 to the measurement data 400 to produce output 402. The definitions files 420 include a data source list 422 defining the various data sources and an attributes list 421 defining attributes and assigning attribute values to the data sources. Alternately or additionally, the definitions files 420 can include a list defining other entities, such as network users. The rules files 410 may include alarm conditions 412 and alarm exceptions 411. When the alarm conditions 412 are met, alarms can be sent to one or more users. When the alarm exceptions are met, certain alarm conditions may be disabled. Alternately or additionally, the rules files 410 can include alarm notifications specifying the particular format and content of an alarm or notification to send to a user when an alarm condition is met.

As will be explained more fully below, an alarm management system for an energy delivery network may be configured by defining data sources 422 (and other entities) and attributes 421. Attribute values are associated with data sources (and other entities) and alarm conditions 412 and exceptions 411 are defined in terms of attribute values and/or measurement data. The alarm management system is operated by receiving measurement data 400 from the data sources and evaluating the measurement data to determine whether the alarm conditions 412 and/or exceptions 411 have been met. The results or output 402 of the evaluation can then be provided to system users in the form of alarms and/or notifications.

Figure 5:
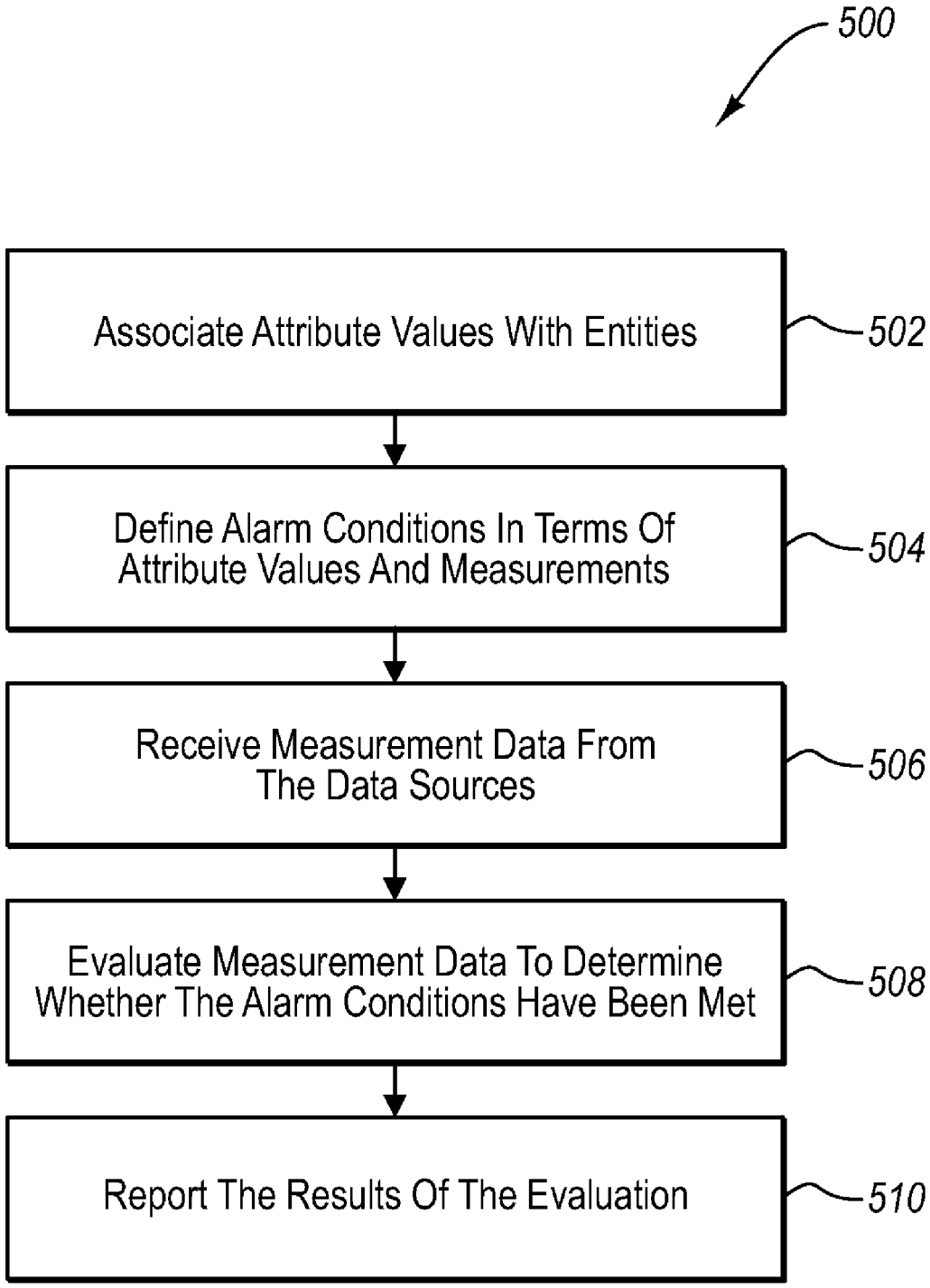
FIG. 5 is a flow chart illustrating one embodiment of a method for configuring and operating an alarm management system.

Turning now to FIG. 5, one embodiment of a method 500 for configuring and operating an alarm management system for an energy delivery network is illustrated. The method 500 may be performed, for instance, by the alarm management system server 110 of FIG. 1. The method 500 begins by associating 502 attribute values with entities, such as data sources and/or alarm system users, after the entities have been defined within the energy delivery network. Alternatively, these associations may already exist. As mentioned above, the entities may be capable of generating measurement data for one or more measurement types. In one embodiment, the attribute values are associated 502 with the entities in response to or after receiving user input defining attributes and assigning attribute values corresponding to the defined attributes to the entities. In some instances, these attribute values can be provided by default or by detecting the data source.

The method 500 continues by defining 504 alarm conditions in terms of attribute values and measurement types. In one embodiment, defining 504 alarm conditions includes receiving user input defining the alarm conditions. The alarm conditions can be defined using regular expression operations and/or Boolean operations or in other manners. Consequently, an alarm condition can combine two or more conditions to form a compound alarm condition. Additionally, the alarm conditions can include the use of numeric values and/or percentages of attribute values for comparison with measurement data received from an entity such as a data source. Consider the following non-limiting example:

A data source performs at least two measurement types, including the measurement of kilowatt demand and average current for the data source. Additionally, the data source has at least two associated attribute values, including City A (corresponding to a "city" attribute) and $I_{max}$ (corresponding to a "maximum current" attribute). A first alarm condition can be defined that uses a numeric value for comparison with a measurement type, such as: send an alarm if kilowatt demand is greater than 10 kilowatts. In this case, the alarm is sent if the measurement type (kilowatt demand) exceeds the numeric value (10 kilowatts).

Where there are multiple entities located in multiple cities that measure kilowatt demand, the first alarm condition could be further modified as follows: send an alarm if the kilowatt demand from any of the entities within City A is greater than 10 kilowatts. Note that this modified first alarm condition illustrates one embodiment of defining an alarm on a group of data sources rather than one data source at a time. Further, this modified alarm condition combines two conditions (e.g., first, that kilowatt demand of an entity exceed 10 kilowatts, and second, that the entity have a "City A" city attribute value) to form a compound alarm condition.

Alternately and/or additionally, a second alarm condition can be defined that uses a percentage of an attribute value for comparison with a measurement type, such as: send an alarm if average current is greater than 90% of $I_{max}$. In this example, the alarm is sent if the measurement type (average current) exceeds the particular percentage (90%) of the attribute value ($I_{max}$). One skilled in the art will appreciate that both the first and second alarm conditions can be expressed using regular expressions and/or Boolean expressions.

Alternately or additionally, a third alarm condition can be defined that uses a numeric value and/or a percentage of an attribute value for comparison with an aggregate measurement type from multiple data sources, such as: send an alarm if the aggregate kilowatt demand from all of the data sources within City A is greater than 30 kilowatts. Thus, the alarm is sent if the aggregate measurement type (e.g., the sum of the kilowatt demand from all data sources having a "City A" city attribute value) exceeds the numeric value (30 kilowatts).

In some of the embodiments described above, attributes and alarm conditions are defined by a user and attribute values are associated with entities in response to user input. In another embodiment of the invention, some or all of these steps can be enhanced and or automated. For example, attribute values can be associated 502 with entities in response to or after receiving one or more packaged attribute templates, which may be supplied via a computer readable medium. In this case, each template includes one or more pre-defined groups of attributes designed for a particular monitoring application. Each pre-defined group may apply to a particular type of entity within the system. Upon receiving a template, attributes of the pre-defined groups can be applied to one or more entities of the system to associate 502 attribute values with the one or more entities.

Alternately or additionally, each template can include one or more pre-defined alarm conditions, each alarm condition being based on one or more of the attributes included in the template. Advantageously, this embodiment of the invention permits a system user to more easily manage alarms and isolate problems when they arise. Accordingly, in this embodiment of the invention it may not be necessary for a system user to explicitly define 504 any alarm conditions at all since pre-defined alarm conditions are already available. Instead, the system user can "define" 504 an alarm condition by selecting one or more pre-defined alarm conditions from a list of available alarm conditions via a graphical user interface and/or one or more alarm conditions may be applied by default.

As an example, consider a circuit alarm monitoring application within a data center. Attributes such as "Circuit Name," "Location," "Server Owner," and the like and alarm conditions based on these attributes can be pre-defined in a data center template package. When the template is received, one or more of the attributes can be applied to each circuit and corresponding attribute values can be associated with each circuit. A system user can then "define" 504 an alarm condition by selecting a pre-defined alarm condition relating to circuit monitoring and/or a default alarm condition can be applied.

Returning to FIG. 5, the alarm server receives 506 measurement data from data sources within the energy delivery network. In some instances, embodiments of the invention may begin by receiving measurement data from data sources. As already explained above, the measurement data may be received by the alarm server in any of a number of ways, including scanning the data sources, sending requests to the data sources for stored measurement data, having the data sources push the measurement data to the alarm server, and the like or any combination thereof.

The alarm server evaluates 508 the received measurement data to determine whether the alarm conditions have been met. In one embodiment, this includes determining whether a situation defined in an alarm condition is true. For instance, in the previous example, the second alarm condition is met (e.g., is true) if the average current measured by the data source exceeds 90% of the $I_{max}$ attribute value assigned to the data source. By way of comparison, the first alarm condition is not met (e.g., is false) if the kilowatt demand measured by the data source is less than 10 kilowatts.

Finally, the alarm server reports 510 the results of the evaluation to one or more alarm system users or to one or more nodes of the alarm system for further processing. As previously mentioned, attribute values can be associated with alarm system users. Consequently, the desired recipients of the results of the evaluation can be defined at step 504 using one or more attribute values in the alarm condition. Accordingly, reporting 510 the results of the evaluation may include identifying all users having the one or more attribute values specified in the alarm condition and providing the results of the evaluation to the identified users.

In one embodiment, the results of the evaluation may be a data set identifying data sources that match the alarm condition. Reporting 510 the results of the evaluation to an alarm system user may comprise transmitting an alarm or notification for presentation to the user. For instance, a notification in the form of a short message service ("SMS") message, email message, page, voice message, instant message, and the like or any combination thereof can be generated and sent to the user via a user device such as a cellular telephone, pager, computer, and so on. Alternately or additionally, an active alarm can be presented on a dedicated monitoring device designed to only present active alarms for the energy delivery network. Such a dedicated monitoring device can display, for example, a table of active alarms that are grouped/sorted by attributes, etc. Furthermore, alarms and/or notifications can be distributed to multiple alarm system users. More specifically, alarms can be distributed to the devices associated with the alarm system users, such as to the user devices 120 and 122 of FIG. 1.

The particular format and content of an alarm or notification for a user can be specified, in one embodiment, by defining an alarm notification in terms of one or more attribute values, one or more measurements, and a descriptive message. For instance, a user attribute value can specify one or more users. Of course, this may include defining a user attribute and associating the user attribute value with the one or more users. The measurement used in evaluating the alarm notification can incorporate the results of the alarm condition evaluation. As one example, the measurement can be a measurement of a state of an alarm condition, such as whether the alarm condition has been met or not (e.g., whether it is true or false). Hence, reporting 510 the results of the evaluation to an alarm system user can first require associating an attribute value with the user, defining an alarm notification, and processing the output of the alarm condition evaluation to determine whether to send the alarm notification. If the alarm notification is met based on the attribute value and measurement, the notification including the descriptive message is transmitted to the one or more users.

One skilled in the art will appreciate that the method 500 is illustrative only and that some or all of the steps can be performed in a different order than illustrated, can be repeated, and/or can be omitted altogether. Additional steps can also be performed without departing from the principles of the present invention. For instance, the method 500 may further include defining alarm exceptions in terms of attribute values and measurements. Alarm exceptions can be used in one embodiment to temporarily disable or modify alarm conditions.

As an example, consider a circuit in an energy delivery network where the circuit includes various data sources. An attribute value indicating that the data sources belong to the particular circuit can be assigned to each data source. Further, an alarm condition can be defined that sends an alarm when any one of the data sources of the circuit appears to be off. If the entire circuit were turned off to receive scheduled maintenance, nuisance alarms for one or more of the data sources on the circuit might be generated indicating that the data sources were off. However, an alarm exception can be defined which prevents alarms from being sent when the circuit is off due to the scheduled maintenance.

More generally, alarm exceptions can be defined which totally or partially disable alarm conditions. An alarm condition is totally disabled if the alarm condition is satisfied, an alarm is not reported to any users, and the system does not record that the alarm condition is satisfied. An alarm condition is partially disabled if the alarm condition is satisfied and the alarm is not reported to any users, but the system records that the alarm condition is satisfied. Thus an alarm condition can have any one of a plurality of states, such as enabled, partially disabled, and totally disabled.

Accordingly, measurement data is evaluated 508 to determine whether both the alarm conditions and alarm exceptions have been met prior to reporting 510 the results of the evaluation. In this embodiment, the method 500 may include scanning alarm conditions for attribute values and measurements in use and matching them to data sources, and then scanning alarm exceptions for all attribute values and measurements that have been partially or totally disabled. For all attribute values and measurements that are enabled or only partially disabled, measurement data can be read and recorded from the data sources. Additionally, alarms can be triggered for enabled attribute values and measurements.

In one embodiment of the invention, alarm exceptions can be defined to apply indefinitely or using a time-dependent component. For example, an alarm exception can be defined to expire on a particular date or time or after the passage of a specified period of time, after which the alarm exception no longer affects a corresponding alarm condition. Alternately or additionally, an alarm exception can be defined according to a particular schedule (e.g., daily, weekly, monthly, and the like) such that a corresponding alarm condition is enabled, partially disabled, or totally disabled based on a time dimension measurable by the system (e.g., time of day, shift, day of week, and the like).

Figure 6:
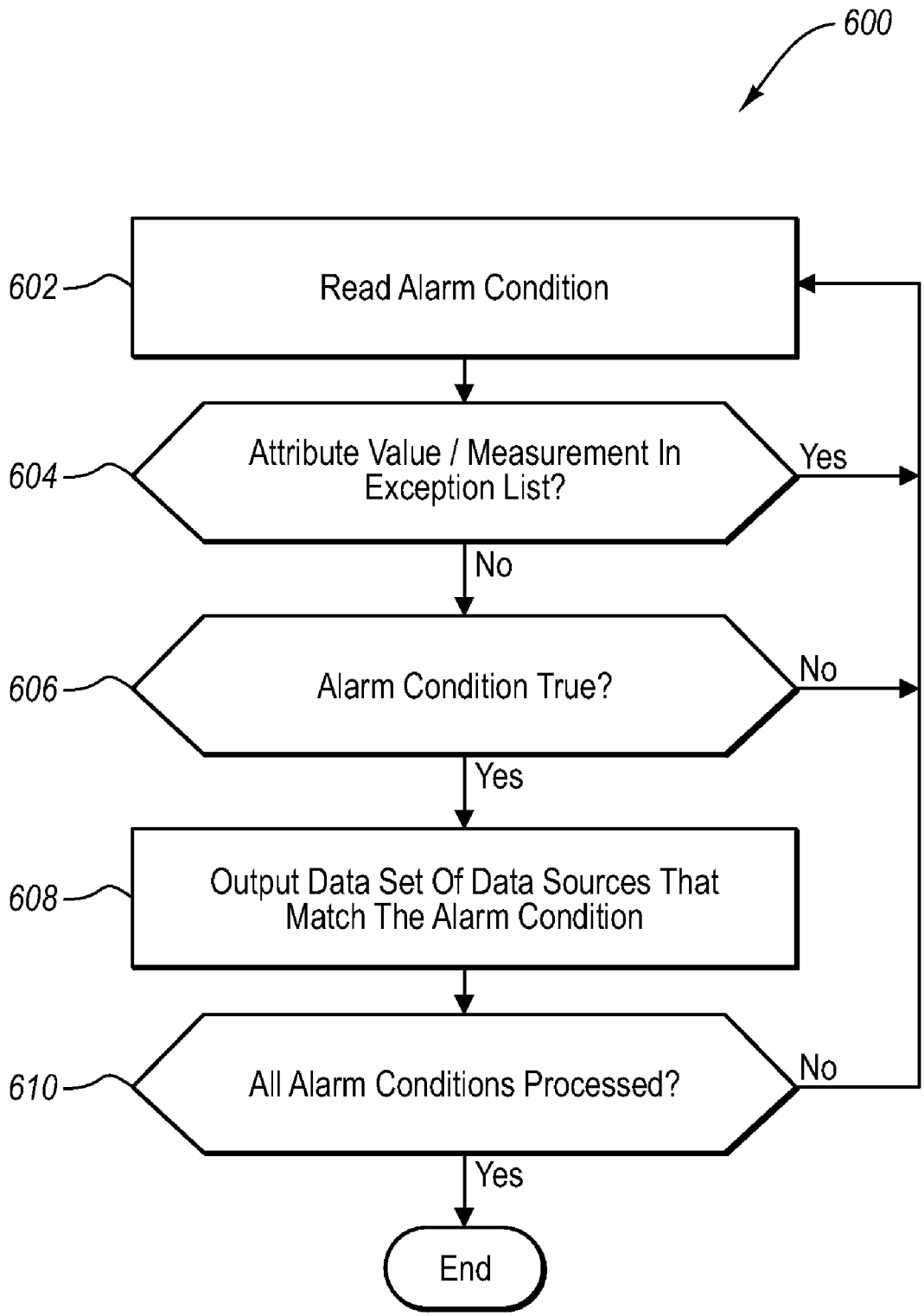
FIG. 6 depicts one embodiment of a method for evaluating measurement data, alarm conditions and alarm exceptions.

In this embodiment, the method 500 can continue by evaluating measurement data and alarm conditions one at a time as depicted in the method 600 of FIG. 6. The alarm server reads 602 an alarm condition. If it is determined 604 that the attribute value or measurement corresponding to the alarm condition is in the exception list, the alarm server proceeds to read 602 the next alarm condition. If not, the alarm server next determines 606 whether the alarm condition has been met by the attribute value and measurement. If the alarm condition has not been met, the alarm server reads 602 the next alarm condition. If the alarm condition has been met, the alarm server outputs or reports 608 a data set of data sources that match the alarm condition. If it is determined 610 that not all of the alarm conditions have been processed, the alarm server reads 602 the next alarm condition. If all the alarm conditions have been processed 610, the method 600 terminates until initiated again at a later time during the method 500 of FIG. 5.

The method of FIG. 6 has been described in the context of an alarm exception that totally disables a corresponding alarm condition. One skilled in the art will appreciate that the method 600 can be modified according to various factors such as the alarm exception only partially disabling the alarm condition, the alarm exception having a time-dependent component, and the like or any combination thereof.

Embodiments within the scope of the present invention include computer-readable media for carrying or having computer-executable instructions or electronic content structures stored thereon, and these terms are defined to extend to any such media or instructions that are used with transceiver and other device modules. By way of example, and not limitation, such computer-readable media can comprise RAM, ROM, EEPROM, CD-ROM or other optical disk storage, magnetic disk storage or other magnetic storage devices, or any other medium which can be used to carry or store desired program code in the form of computer-executable instructions or electronic content structures and which can be accessed by a general purpose or special purpose computer, or other computing device.

When information is transferred or provided over a network or another communications connection to a computer or computing device, the computer or computing device properly views the connection as a computer-readable medium. Thus any such a connection is properly termed a computer-readable medium. Combinations of the above should also be included within the scope of computer-readable media. Computer-executable instructions comprise, for example, instructions and content which cause a general purpose computer, special purpose computer, special purpose processing device or computing device to perform a certain function or group of functions.

Although not required, aspects of the invention have been described herein in the general context of computer-executable instructions, such as program modules, being executed by computers in network environments. Generally, program modules include routines, programs, objects, components, and content structures that perform particular tasks or implement particular abstract content types. Compute-executable instructions, associated content structures, and program modules represent examples of program code for executing aspects of the methods disclosed herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for configuring and operating an alarm system for an energy delivery network, the method comprising:

responsive to receiving an indication to associate a plurality of attribute values with at least one data source:

associating the plurality of attribute values with the at least one data source, each of the plurality of attribute values relating to a corresponding attribute of the at least one data source, the at least one data source generating measurement data for a corresponding measurement type that relates to the energy delivery network, defining a first alarm condition based at least in part on the plurality of attribute values and the measurement type corresponding to the measurement data generated by the at least one data source, and evaluating the measurement data received from the at least one data source to determine whether the first alarm condition has been met; and responsive to receiving an indication to associate an attribute value with a plurality of distinct data sources:

associating the attribute value with the plurality of distinct data sources, the attribute value relating to an attribute common to the plurality of distinct data sources, each of the distinct data sources generating respective measurement data for a corresponding measurement type that relates to the energy delivery network, defining a second alarm condition based at least in part on the attribute value and the measurement type corresponding to the measurement data generated by at least one of the plurality of distinct data sources, and evaluating the respective measurement data received from the plurality of data sources to determine whether the second alarm condition has been met.

2. A method of configuring and operating an alarm system as defined in claim 1, wherein defining the first alarm condition includes the use of Boolean operations, regular expression operations, or both.

3. A method of configuring and operating an alarm system as defined in claim 1, wherein defining the first alarm condition includes the use of numeric values for comparison with the measurement data received from the at least one data source.

4. A method of configuring and operating an alarm system as defined in claim 1, wherein defining the first alarm condition includes the use of a percentage of at least one attribute value for comparison with the measurement data received from the at least one data source.

5. A method of configuring and operating an alarm system as defined in claim 1, wherein defining the first alarm condition includes combining two or more alarm conditions, each of which must be met to satisfy the first alarm condition.

6. A method of configuring and operating an alarm system as defined in claim 1, further comprising, distributing results obtained by evaluating the measurement data received from the at least one data source to a plurality of nodes in the alarm system.

7. A method of configuring and operating an alarm system as defined in claim 1, further comprising, defining at least one alarm exception in terms of at least one of the following: an attribute value and a measurement type.

8. A method of configuring and operating an alarm system as defined in claim 7, wherein the alarm exception is defined to change the state of the first or the second alarm condition from enabled, partially disabled, or totally disabled to enabled, partially disabled, or totally disabled according to a particular schedule.

9. A method of configuring and operating an alarm system as defined in claim 7, further comprising, partially or totally disabling evaluation of at least one alarm condition meeting the alarm exception criteria.

10. A method of configuring and operating an alarm system as defined in claim 9, wherein the alarm exception is defined to expire on a particular date, at a particular time, or after a specified period of time such that it no longer operates to partially or totally disable evaluation of the at least one alarm condition after expiring.

11. A method of configuring and operating an alarm system as defined in claim 1, further comprising, reporting the results obtained by evaluating the measurement data received from the at least one data source to at least one alarm system user.

12. A method of configuring and operating an alarm system as defined in claim 11, wherein reporting the results includes:

associating at least one user attribute value with the at least one alarm system user;

defining at least one alarm notification in terms of the at least one user attribute value, at least one measurement type, and a descriptive message; and processing the results obtained by evaluating the measurement data received from the at least one data source to determine whether to transmit the at least one alarm notification to the at least one alarm system user.

13. A method of configuring and operating an alarm system as defined in claim 12, wherein the user attribute value comprises a plurality of user attribute values, the at least one alarm system user comprises a plurality of alarm system users, and the at least one alarm notification comprises a plurality of alarm notifications.

14. A method of configuring and operating an alarm system as defined in claim 1, wherein defining the first alarm condition comprises selecting at least one pre-defined alarm condition from a list of pre-defined alarm conditions included in a template designed for a particular alarm system.

15. A method of configuring and operating an alarm system as defined in claim 14, wherein the template additionally includes at least one pre-defined group of attributes that are applied to the at least one data source prior to associating the attribute values with the at least one data source, and wherein at least one of the attribute values corresponds to one of the pre-defined attributes.

16. A computer program product for use in a computing system that is operably connected to an energy delivery network monitoring system, the computer program product implementing a method for configuring and operating an alarm system for the energy delivery network monitoring system, the computer program product comprising one or more computer-readable media having stored thereon computer executable instructions that, when executed by a processor, cause the computing system to perform the following:

responsive to an indication to associate a plurality of attribute values with at least one data source:

associate the plurality of attribute values with the at least one data source included in the energy delivery network monitoring system, each of the plurality of attribute values relating to a corresponding attribute of the at least one data source, the at least one data source generating measurement data for a corresponding measurement type relating to the energy delivery network;

define a first alarm condition, based at least in part on the plurality of attribute values and the measurement type corresponding to the measurement data generated by the at least one data source, and evaluate the measurement data generated by the at least one data source to determine whether the first alarm condition has been met; and responsive to an indication to associate an attribute value with a plurality of distinct data sources:

associate the attribute value with the plurality of distinct data sources, the attribute value relating to an attribute common to the plurality of distinct data sources, each of the distinct data sources generating respective measurement data for a corresponding measurement type that relates to the energy delivery network, define a second alarm condition based at least in part on the attribute value and the measurement type corresponding to the measurement data generated by at least one of the plurality of data sources, and evaluate the respective measurement data received from the plurality of data sources to determine whether the second alarm condition has been met.

17. The computer program product as defined in claim 16, wherein the computer executable instructions, when executed by a processor, further cause the computing system to perform the following: if the first alarm condition has been met, generate a data set identifying the data source as having generated measurement data that met the at least one alarm condition.

18. The computer program product as defined in claim 16, wherein the first or second alarm conditions is defined using one or more Boolean operations, one or more regular expression operations, or both.

19. The computer program product as defined in claim 16, wherein the first or second alarm conditions is defined using numeric values for comparison with the measurement data received from the at least one data source.

20. The computer program product as defined in claim 16, wherein the first or second alarm condition is defined using a percentage of at least one attribute value for comparison with the measurement data received from the at least one data source.

21. The computer program product as defined in claim 16, wherein the computer executable instructions, when executed by a processor, further cause the computing system to distribute results obtained by evaluating measurement data received from the at least one data source to a plurality of nodes in the alarm system.

22. The computer program product as defined in claim 16, wherein the computer executable instructions, when executed by a processor, further cause the computing system to define at least one alarm exception in terms of at least one of the following: an attribute value and a measurement type.

23. The computer program product as defined in claim 22, wherein the computer executable instructions, when executed by a processor, further cause the computing system to disable evaluation of at least one alarm condition meeting the alarm exception criteria.

24. The computer program product as defined in claim 16, wherein the computer executable instructions, when executed by a processor, further cause the computing system to report the results obtained by evaluating the measurement data received from the at least one data source to at least one alarm system user.

25. The computer program product as defined in claim 24, wherein causing the computer system to report the results obtained by evaluating the measurement data received from the at least one data source to at least one alarm system user comprises causing the computer system to:

associate at least one user attribute value with the at least one alarm system user;

define at least one alarm notification in terms of the at least one user attribute value, at least one measurement type, and a descriptive message; and process the results obtained by evaluating the measurement data received from the at least one data source to determine whether to transmit the at least one alarm notification to the at least one alarm system user.

26. A method for collecting data and providing alarms for a network, the method comprising:

associating two or more attribute values with each of a plurality of entities, each attribute value relating to a corresponding attribute of the respective entity to which the attribute value is assigned, the plurality of entities including at least one data source generating measurement data for a corresponding measurement type that relates to the network;

receiving user input defining one or more alarm conditions, the one or more alarm conditions being defined at least in part in terms of the two or more attribute values and the measurement type corresponding to the measurement data generated by at least one data source;

receiving at least a portion of the measurement data generated by the at least one data source; and evaluating the measurement data received from the at least one data source to determine whether any of the one or more alarm conditions have been met.

27. The method of claim 26, further comprising, in response to determining that at least one of the one or more alarm conditions has been met, transmitting one or more alarms to one or more users of the network.

28. The method of claim 27, wherein the one or more alarms are presented to the one or more users of the network as at least one of:

a descriptive message in a format selected from among one of: a voice message, an email message, a page, a short message service message, and an instant message; and an active alert displayed by a dedicated monitoring device communicably coupled to the network.

29. The method of claim 26, further comprising, prior to associating the one or more attribute values with the plurality of entities, receiving user input:

defining the plurality of entities within the network;

defining one or more attributes, each of the one or more attributes comprising a category of one or more attribute values, wherein each attribute value serves to qualify, identify, classify, quantify, or otherwise express a property or characteristic of an entity; and assigning one or more attribute values to each entity.

30. The method of claim 26, wherein the plurality of entities additionally includes at least one user of the network.

* * * * *